United States Patent [19]

Boström et al.

[11] 4,122,218

[45] Oct. 24, 1978

[54] METHOD AND APPARATUS FOR COATING A WEB

[75] Inventors: Mats Gustav Daniel Boström; Gösta Hudson Hansson; Hans-Erik Lind, all of Karlstad, Sweden

[73] Assignee: Aktiebolaget Karlstads Mekaniska Werkstad, Karlstad, Sweden

[21] Appl. No.: 515,984

[22] Filed: Dec. 23, 1974

[30] Foreign Application Priority Data

May 16, 1974 [SE] Sweden ..... 74965111

[51] Int. Cl.[2] ..... B05C 13/02

[52] U.S. Cl. ..... 427/209; 118/64; 118/65; 118/67; 118/69; 118/224; 118/642; 427/55; 427/211; 427/398 A; 427/428

[58] Field of Search ..... 427/209, 428, 398, 211, 427/55; 118/64, 65, 67, 69, 224, 242

[56] References Cited

U.S. PATENT DOCUMENTS

| | | | |
|---|---|---|---|
| 2,257,373 | 9/1941 | Fanselow | 427/428 X |
| 2,274,792 | 3/1942 | Jennings et al. | 427/428 X |
| 2,280,259 | 4/1942 | Polley | 427/398 X |
| 2,293,691 | 8/1942 | Harrigan | 91/50 |
| 2,309,090 | 1/1943 | Bauer et al. | 427/428 X |
| 2,647,842 | 8/1953 | Griesheimer et al. | 117/64 |
| 3,110,608 | 11/1963 | Brunson et al. | 427/398 X |
| 3,467,296 | 9/1969 | Anderson | 427/428 X |

*Primary Examiner*—Bernard D. Pianalto

*Attorney, Agent, or Firm*—Brumbaugh, Graves, Donohue & Raymond

[57] ABSTRACT

A traveling web is coated on both sides with an aqueous coating composition by a method that utilizes apparatus providing two coating stations. The two coating stations are spaced from each other in the direction of travel of the web and each station includes a backing roll, a doctor blade and a device for applying coating composition to one side of the traveling web. One side of the web is brought into contact with the backing roll at the first coating station and aqueous coating composition is applied to the other side of the web. The web is then passed between the backing roll and the doctor blade at the first coating station. At the second coating station, the coated side of the web is juxtaposed with the backing roll and aqueous coating composition is applied to the uncoated side of the web. The web is passed between the backing roll and the doctor blade at the second coating station, while the doctor blade is maintained in contact with the coating composition applied at the second coating station. To prevent the coating applied at the first coating station from adhering to the backing roll at the second coating station, the surface of the backing roll at the second station is cooled so that moisture in the coating composition applied at the first coating station forms at least part of a film of condensate on the surface of the roll. The coating composition applied at the first coating station thus contacts the film of condensate, rather than the surface of the roll.

9 Claims, 1 Drawing Figure

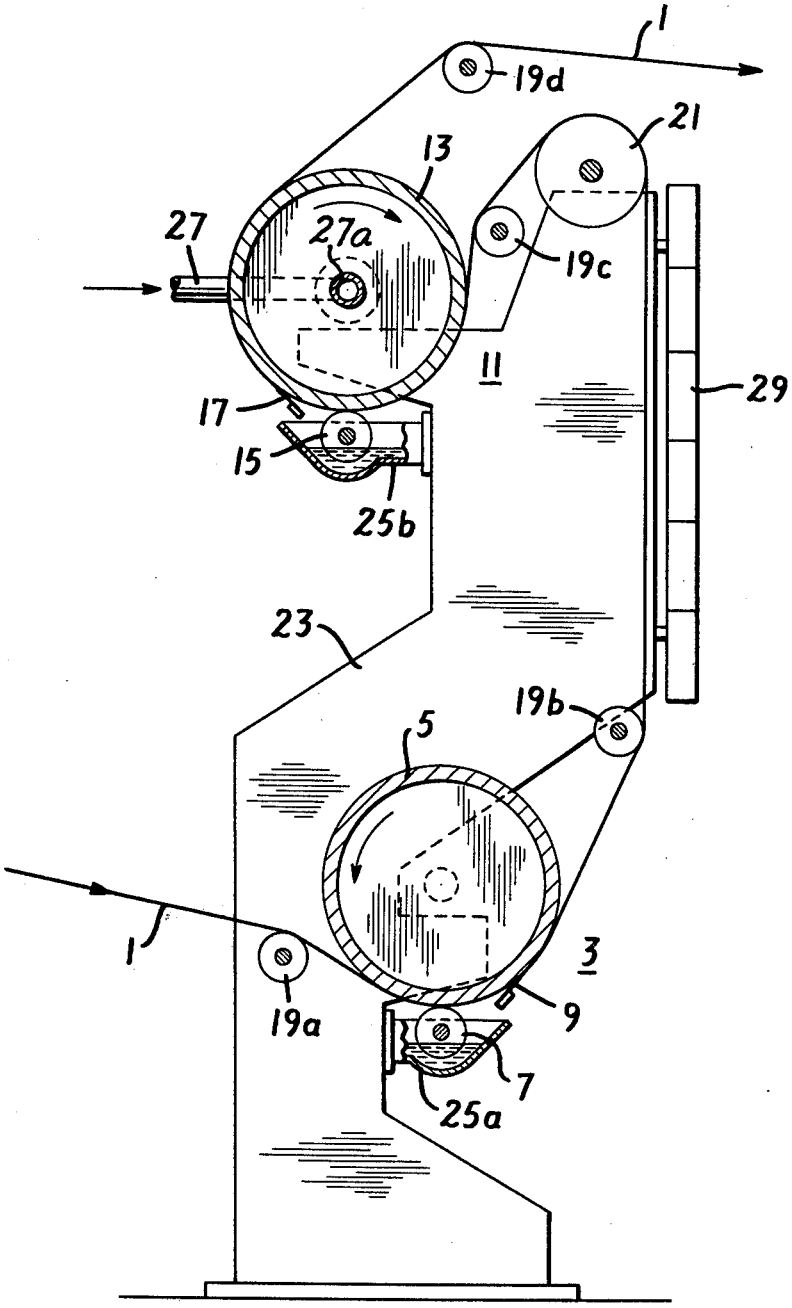
1
19d
21
13
27
27a
19c
11
29
17
15
25b
23
19b
5
1
3
19a
9
7
25a

METHOD AND APPARATUS FOR COATING A WEB

BACKGROUND OF THE INVENTION

In order to improve the gloss, smoothness and ink holding capabilities of paper, it is often desirable to coat the paper with an appropriate composition. One conventional method of coating paper is to apply a layer of a selected coating composition to one side of a web of paper, dry the layer of composition, and then apply a layer of composition to the other side of the web. A good uniform coating can be obtained on both sides of the web, with different thicknesses and/or other qualities of coating on each side, if desired. The method is usually carried out using separate coaters and is referred to as "off-machine" coating. Drying the coating on one side of a web before applying a coating to the other side of the web is expensive, however, and it is usually impossible to rebuild existing paper machinery so as to produce paper coated on both sides using such a coating method. Generally speaking, insufficient space is provided in existing machinery to allow the installation of the two coating stations and the intermediate drying station required by the method.

Another conventional method of coating two sides of a web of paper is described and illustrated in Swedish Pat. Nos. 347,781 and 348,777. The method practiced by the apparatus of the Swedish patents involves applying a liquid coating composition simultaneously to both sides of a moving web of paper and then passing the web between at least one pair of opposed doctor blades that smooth the coating and control the total thickness of the coated paper. While the method permits control of the total thickness of the coated paper, it is not possible to control the thickness of the coating composition on the individual sides of the web, because any attempt to alter the coating thickness on one side of the paper web will simultaneously produce a corresponding change in the coating thickness on the other side of the web of paper. For example, if the blade pressure is increased against one side of the web of paper, a simultaneous increased in pressure between the web and the doctor blade on the other side of the web will also occur. The reciprocal action of the blades also makes it impossible to coat a web of paper with a relatively heavy or thick coating and still maintain adequate control of the process. In practice, the apparatus, such as described and illustrated in the two Swedish patents, is limited to applying a coating of approximately 12 grams of absolutely dry coating composition per square meter of web on each side of a web.

Streb et al U.S. Pat. No. 3,293,067 is directed to a method of applying a liquid coating to both sides of a web of paper using a roll applicator on one side and using trailing blade coating methods on the other side. As indicated in the patent specification, the trailing blade coating methods include applying the coating composition to the web using a dip roll and then doctoring the composition using an inverted flexible blade spaced from the roll in the direction of travel of the web. In the method of the Streb et al. patent, no drying of the composition applied to one side of the web of paper occurs before the application of composition to the other side of the web.

When coating a paper web using the method of the Streb et al. patent, the coatings applied to the two sides of the web are unequal in thickness and the method offers only limited possibilities for controlling the thickness of the coat on each side of the web, especially with quantitatively large applications. A certain two sidedness occurs in the microstructure of the coat and with large applications of coating composition, there is a continuous risk of obtaining a coated paper with pronounced two sidedness. An increase in the amount of coating composition applied to the side of the web coated by the roll coater will also affect the side of the web which is blade coated, because the increased thickness of the coating on the roll-coated side will produce higher pressures between the doctor blade and other side of the paper web.

If both sides of a web of paper are coated using conventional trailing doctor blade coating methods without intermediate drying, the results are also unsatisfactory. In such a process, after the web of paper is wrapped around a backing roll, the coating solution is applied to the web by an applicator roll, for example, and then smoothed and held to desired thickness by a doctor blade. If the coating applied at a first coating station to one side of the web is not dried before coating is applied at a second coating station to the other side of the web, at least part of the coating applied at the first station will be deposited on the backing roll in the second coating station. As a result, both sides of the web will have an irregular coating due to the splitting of the coating film which will take place when the paper web is separated from the backing roll at the second coating station. The coating that develops on the backing roll at the second coating station, which is difficult to clean effectively from the roll, thereafter causes the coating on the side of the web coated at the second coating station to be uneven due to the higher blade pressures resulting in the zones where coating remains stuck on the backing roll. Linear irregularities in the blade pressure cause an unevenly doctored quantity of coating across the fibrous web, resulting in a product of unacceptable quality.

SUMMARY OF THE INVENTION

The present invention is directed to a method and apparatus for continuously coating both sides of a web of material, such as paper, which produces a satisfactory coated product, does not require a drying station before both sides of the web are coated and permits sufficient control of the coating thickness on each side of the web to permit variations in the coating thicknesses independent of each other.

In accordance with the invention, apparatus for continuously coating both sides of a traveling web comprises two coating stations spaced a short distance apart from each other in the direction of travel of the web. Each coating station includes a backing roll, a doctor blade and a device for applying aqueous coating composition to one side of the traveling web. In operation, in accordance with the method of the invention, one side of a web of paper is brought into contact with the backing roll at the first coating station and aqueous coating composition is applied to the other side of the web. The web is then passed between the backing roll and the doctor blade at the first coating station, while the backing roll is maintained in contact with the web and the doctor blade is maintained in contact with the coating composition applied at the station. Thereafter, the coated side of the web is juxtaposed with a surface of the backing roll at the second coating station and aqueous coating composition is applied to the uncoated side of the web. The web is passed between the backing roll and the doctor blade at the second coating station, while the web is maintained in juxtaposition with the backing roll and while the doctor blade is maintained in contact with the coating composition applied at the second coating station.

In order to prevent the composition applied at the first coating station from adhering to the backing roll at the second coating station, the surface of the backing roll at the second coating station is cooled by appropriate apparatus so that moisture in the composition applied at the first coating station forms at least part of a film of condensate on the surface of the second backing roll. The film of condensate effectively separates the composition applied to the web at the first coating station from the cooled surface of the backing roll at the second coating station. The coating on the first-coated side of the web can thus be easily and effectively separated from the backing roll at the second coating station without any coating adhering to and remaining on the backing roll.

The length of the web extending between the point at which the doctor blade contacts the coating composition applied at the first coating station and the point at which the composition on the coated side of the web contacts of the film of condensate on the cooled surface of the backing roll at the second coating station depends upon the space required to fit the components of the two coating stations. While this space depends upon the size of the paper machine in which the coating apparatus is used, the required length of web in large conventional machines is calculated not to exceed seven meters. The effectiveness of the method and apparauts can be enhanced by providing a heater, such as an infrared heater, intermediate the two coating stations to heat the coating applied to the web at the first coating station. By so heating the composition, the difference in temperature between the composition and the cooled surface of the backing roll at the second coating station is increased.

As can be seen by the above description, the present invention facilitates the use of conventional trailing blade coating processes and apparatus in continuous coating of two sides of a web of paper, while eliminating the requirement of and the apparauts for drying the coating applied to one side of the web before a coating is applied to the other side of the web. By eliminating the drying apparatus, the space into which apparatus for practicing the present invention method can be fitted is greatly reduced and existing machinery can be more easily adapted to practice the method.

The two coating stations of the present invention can be controlled individually within wide limits. By selectively varying the controllable variables, such as blade pressure and the angle of the doctor blade to the web of paper, the coating on each side of the web can be varied separately and selectively without reciprocal variation occurring in the coating on the other side of the web. The apparatus also permits convenient sandwich coating of a web of paper in which one coat of a relatively simple and cheap coating composition is applied at one coating station and then covered by a thin surface coat of high quality coating composition at a downstream coating station. A coating of up to 30 grams of absolutely dry coating composition per square meter of web can be applied to each side of the web, while maintaining full control of the inventive process.

It has been demonstrated that the inventive apparatus can be operated satisfactorily for coating compositions of up to 15 grams of absolutely dry coating composition per square meter of web on each side of a web of paper simply by intense cooling of the backing roll at the second coating station. In order to apply heavier coats of compositin, however, it is necessary to increase the temperature differential between the surface of the backing roll at the second coating station and the coating applied at the first coating station. The temperature differential can be increased conveniently with an intermediate heating station, as described above, utilizing infrared radiation or some other heating method to heat the coating applied at the first coating station. By reducing or increasing the intensity of the infra-red radiation, an additional control is provided over the production of the condensate film on the backing roll of the second coating station. When the newly applied coat of composition on the paper web is subjected to the infra-red heating, the viscosity of the coating composition is reduced and liquid penetrates rapidly into the paper web, while vaporization of water takes place from the coating before and during its contact with the chilled backing roll. Water which is vaporized from the coating and which comes into contact with the face of the chilled backing roll condenses rapidly and assists in producing the condensate film.

DESCRIPTION OF THE DRAWING

For a better understanding of the invention, reference may be made to the following description of an exemplary embodiment, taken in conjunction with the accompanying drawing which presents a side view, partly in section, of apparatus according to the invention.

DESCRIPTION OF AN EMBODIMENT

The FIGURE of the drawing illustrates a continuous web 1 of paper or other material that is to be coated on both sides with a selected coating composition being fed through apparatus for coating the web. The apparatus is primarily intended to be installed in a paper machine, for example, in place of the size press. The apparatus comprises a first coating station, generally designated 3, and a second coating station, generally designated 11, spaced from the first coating station in the direction of travel of the web. The various elements making up both coating stations 3 and 11 and the related guide rolls 19 *a–d* are all mounted on an upright frame 23. The direction of travel of the paper web 1 is indicated by the arrows on the web.

The web of paper 1 is introduced into the apparatus over a lead roll 19*a* that directs the web into the first coating station 3. In the first coating station 3, one side of the web of paper 1 is brought into contact with a rotating backing roll 5 that is mounted on the apparatus frame 23. The web 1 is wrapped around the backing roll 5 and passes between the roll and a rotating applicator roll 7 that applies a selected aqueous coating composition to the side of the web which is not against the backing roll. The lower portion of the applicator roll 7 is immersed in a quantity of the coating composition held in a receptacle 25a mounted on the frame 23.

After the composition has been applied to one side of the web 1, the web, while still being held in contact with the backing roll 5, is passed between the backing roll 5 and a doctor blade 9 that smooths out the coating of composition applied by the applicator roll 7 and controls the thickness of the coating. Surplus coating composition runs back into the receptacle 25*a*. The coating thickness is controlled by controlling the pressure of the blade 9 on the web and controlling the angle of the blade relative to the web in a conventional manner. The apparatus for controlling the blade 9 is conventional and is not shown in the drawing for clarity.

Upon leaving the first coating station 3, the web 1 passes over a second lead roller 19b and travels in a generally vertical direction up to a roll 21 mounted adjacent the top of the frame 23. Mounted on the frame 23, so as to be adjacent and parallel to the web 1 as it travels between the lead roll 19b and the roll 21, is an infra-red radiation element 29. The element 29 heats the liquid coating composition that has been applied to the web 1 at the first coating station 3 to enhance the operation of the apparatus, as will be described hereinafter.

From the roll 21, the web of paper 1 passes over another lead roll **19*c* and into the second coating station 11. At the second coating station 11, the web of paper 1 is brought into juxtaposition with a rotating backing roll 13, which may be fabricated of steel or a non-ferrous metal. Generally speaking, the web 1 might be said to be in contact with the surface of the backing roll 13, but, in fact, a thin film of condensate exists between the web and the backing roll 13, as described hereinafter. The side of the web 1 that is juxtaposed with the backing roll 13 is the side that was ciated with composition at the first coating station 3**.

A layer of coating composition is applied to the web 1 by a rotating applicator roll 15. The lower portion of the roll 15, like the roll 7, is immersed in a bath of composition held in receptacle 25b mounted on the frame 23. After a quantity of coating composition has been applied to the uncoated side of the web 1, the web passes between the backing roll 13 and a doctor blade 17. The doctor blade 17, like the blade 9 in the first coating station 3, smoothes out and controls the thickness of the layer of composition applied at the second coating station. After traveling for approximately 260° around the circumference of the backing roll 13, the web of paper 1 is guided away from the backing roll 13 and the apparatus by a guide roll **19*d***.

In accordance with the invention, the outer circumferential surface of the backing roll 13 in the second coating station 11 is cooled by a conventional cooling liquid that is supplied through a supply pipe 27 to a pipe **27*a* extending axially through the roll 13. After flowing the length of pipe 27*a*, the cooling liquid is removed from the roll through a return pipe (not shown) similar to supply pipe 27. The distribution of the cooling liquid in the roll 13 and the removal of the cooling liquid from the roll may be accomplished in any other conventional manner. Due to the difference in temperature between the cooled circumferential surface of the backing roll 13 and the warm moist coating applied at the coating station 3 and also due to the moisture in the atmosphere, a film of condensate is formed on the chilled surface of the roll. The condensate film effectively separates the web 1 from the surface of the roll 13** and prevents the coating composition applied at the first coating station from sticking to and remaining on the surface of the roll.

The formation of the condensate film on the backing roll 13 is dependent on several variables within the process, such as the magnitude of the temperature difference between the coating on the web 1 and the surface of the roll, the composition of the coating, the quantity of the coating and the humidity of the ambient atmosphere. An increase in the temperature differential, for example, assists in the formation of a more effective condensate film. When coating the web 1 with large quantities of composition, it will be necessary to use the infrared radiation element 29 to heat the coating applied at the first coating station 3 in order to insure the formation of a condensate film on the roll 13 sufficiently effective to prevent adherence of the coating composition to the roll. Part of the water in the coating composition is withdrawn from the coating in a steam phase, immediately before the coating contacts the backing roll 13, and condenses on contact with the chilled surface of the roll 13. By controlling the intensity of the infrared radiation and the cooling of the backing roll 13, it is possible to control the process fully with regard to the variables which exist in it.

While the apparatus illustrated in the drawing and described above utilizes rotatable applicator rolls to apply the coating composition to the web 1, the composition may be applied in any other conventional manner, such as by spraying, or a combination of any other known methods of application. It will also be appreciated that the space required for installation of apparatus such as is illustrated in the drawing in a paper machine depends on the size of the paper machine and its design. The length of the web extending between the point at which the doctor blade 9 contacts the web in the first coating station 3 and the point at which the web first contacts the backing roll 13 in the second coating station 11 will differ depending on the dimensions and design of the two coating stations. For larger paper machines, the required length of web is calculated not to exceed seven meters.

It will be understood that the embodiment described above is merely exemplary of apparatus for practicing the inventive process and that persons skilled in the art may make many variations and modifications without departing from the spirit and scope of the invention. All such modifications and variations are intended to be within the scope of the invention as defined in the appended claims.

We claim:

1. A method of continuously coating both sides of a traveling web with at least one aqueous coating composition comprises the steps of:

(a) bringing one side of the web into contact with a first backing roll at a first coating station;

(b) applying an aqueous coating composition to the other side of the web at the first coating station;

(c) passing the web between the first backing roll and a first means for smoothing the coating at the first coating station, while maintaining the first backing roll in contact with the web and the first smoothing means in contact with the coating composition applied to the other side of the web;

(d) juxtaposing the other side of the web with a surface of a second backing roll at a second coating station;

(e) applying an aqueous coating composition to the one side of the web at the second coating station;

(f) passing the web between the second backing roll and a second means for smoothing the coating at the second coating station, while maintaining the other side of the web in juxtaposition with the surface of the second backing roll and the second smoothing means in contact with the coating composition applied to the one side of the web; and cooling the surface of the second backing roll so that moisture in the aqueous coating composition applied to the web at the first coating station forms at least a part of a film of condensate maintained on the surface of the second backing roll, the coating composition applied to the web at the first coating station being in contact with the film of condensate when the other side of the web is juxtaposed with the surface of the second backing roll.

2. A method according to claim 1, further comprising the step of heating the aqueous coating composition on the other side of the web before bringing the other side of the web into juxtaposition with the surface of the second backing roll, so as to increase the temperature differential between the coating composition on the other side of the web and the surface of the second backing roll.

3. An apparatus for continuously coating both sides of a traveling web with at least one aqueous coating composition comprising:

(a) a first coating station including
  (i) a first backing roll,
  (ii) first means for smoothing a coating, and
  (iii) first means for applying an aqueous coating composition to a side of the traveling web, the first backing roll and the first smoothing means being arranged so that the traveling web passes between them with the backing roll contacting the web and the smoothing means contacting the aqueous coating composition applied to the web by the first applying means; and
(b) a second coating station spaced from the first coating station in the direction of travel of the web including
(i) a second backing roll,
  (ii) second means for smoothing a coating,
  (iii) second means for applying an aqueous coating composition to a side of the traveling web, and
(iv) means for cooling a surface of the second backing roll so that moisture in the aqueous coating composition applied to the web at the first coating station forms at least a part of a film of condensate maintained on the cooled surface of the second backing roll, the second backing roll and the second smoothing means being arranged so that the traveling web passes between them with the second smoothing means contacting the aqueous coating composition applied to the web by the second applying means, the coating stations being arranged so that the aqueous coating composition applied at the first coating station is applied to one side of the web and the aqueous coating composition applied at the second coating station is applied to the other side of the web, the one side of the web being juxtaposed with the cooled surface of the second backing roll at the second coating station so that the coating composition on the one side of the web is in contact with the film of condensate on the cooled surface of the second backing roll.

4. An apparatus according to claim 3, wherein the coating stations are spaced from each other so that the maximum length of traveling web extending between a point at which the first smoothing means contacts the coating composition on the one side of the web and a point at which the coating composition on the one side of the web first contacts the film of condensate on the cooled surface of the second backing roll is 7 meters.

5. An apparatus according to claim 3, further comprising means for heating the coating composition applied to the web by the first applying means, the heating means being located between the two coating stations.

6. A method of continuously coating liquid coating compositions onto both sides of a web travelling along a predetermined path comprising the steps of applying an aqueous coating composition to one side of the web at a first coating station along the path of travel of the web, bringing the then coated side of the web into contact with and leading it around a part of the perimeter of a backing roll located at a second coating station downstream, relative to the direction of travel of the web, from the first coating station, maintaining the surface of the backing roll at a temperature substantially below that of the coating applied to the web at the first coating station such that a film of condensate is formed on the surface of the backing roll due in substantial part to condensation on the roll of moisture in the coating on said one side of the web, and while the web is in contact with the backing roll coating the other side of the web with a liquid coating composition.

7. A method according to claim 4 and further comprising the step of heating the coating on said one side of the web between the first and second coating stations to increase the temperature differential between the coating and the surface of the backing roll.

8. An apparatus for continuously coating liquid coating compositions onto both sides of a web travelling along a predetermined path comprising means at a first location along the path of travel of the web for applying an aqueous coating composition to one side of the web, a backing roll located at a second location along the path of travel of the web downstream, relative to the direction of travel of the web, from the first location, means for bringing said one side of the web into contact with the backing roll and for leading the web around a part of the perimeter of the backing roll, means for maintaining the surface of the backing roll at a temperature substantially below that of the coating applied to the web by the said coating means such that a film of condensate is formed on the surface of the backing roll due in substantial part to condensation on the roll of moisture in the coating on said one side of the web, and means for applying to the other side of the web liquid coating composition while the web is in contact with the backing roll.

9. An apparatus according to claim 6 and further comprising means for heating the coating on said one side of the web between said first and second locations to increase the temperature differential between the coating on said one side of the web and the surface of the backing roll.

* * * * *

UNITED STATES PATENT AND TRADEMARK OFFICE

CERTIFICATE OF CORRECTION

PATENT NO. : 4,122,218

DATED : October 24, 1978

INVENTOR(S) : Mats Gustav Daniel Bostrom et al.

It is certified that error appears in the above-identified patent and that said Letters Patent are hereby corrected as shown below:

Cover page, item [54] Inventors, "Boström" should be --Boström--; item [30] (priority data), "74965111" should be --7406511 --; Column 3, line 25, delete "of" (first occurrence); line 32, "apparauts" should be --apparatus--; line 44, "apparauts" should be --apparatus--; line 48, "invention" should be --inventive--; Column 4, line 5, "compositin" should be --composition--; Column 5, line 25, "ciated" should be --coated--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*